US006739519B2

(12) United States Patent
Stout et al.

(10) Patent No.: US 6,739,519 B2
(45) Date of Patent: May 25, 2004

(54) PLURALITY OF BARRIER LAYERS

(75) Inventors: Joe E. Stout, Corvallis, OR (US); Thomas R. Strand, Corvallis, OR (US); Jeremy H. Donaldson, Corvallis, OR (US); Paul Benning, Corvallis, OR (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/210,561

(22) Filed: Jul. 31, 2002

(65) Prior Publication Data

US 2004/0021005 A1 Feb. 5, 2004

(51) Int. Cl.[7] ..... B05B 1/08
(52) U.S. Cl. ..... 239/102.2; 239/494; 239/596
(58) Field of Search ..... 239/102.1, 102.2, 239/494, 491, 596, 552

(56) References Cited

U.S. PATENT DOCUMENTS

| | | | | |
|---|---|---|---|---|
| 5,455,613 A | * | 10/1995 | Canfield et al. | 347/65 |
| 5,478,606 A | | 12/1995 | Ohkuma et al. | |
| 5,612,724 A | * | 3/1997 | Murakami et al. | 347/64 |
| 5,980,017 A | | 11/1999 | Sato | |
| 6,036,874 A | | 3/2000 | Farnaam | |
| 6,123,863 A | | 9/2000 | Shimomura et al. | |
| 6,162,589 A | | 12/2000 | Chen et al. | |
| 6,179,413 B1 | | 1/2001 | Coulman et al. | |
| 6,239,820 B1 | * | 5/2001 | Figueredo et al. | 347/50 |
| 6,290,337 B1 | * | 9/2001 | Radke | 347/65 |
| 6,450,622 B1 | * | 9/2002 | Nguyen et al. | 347/63 |
| 6,454,393 B2 | * | 9/2002 | Chen et al. | 347/47 |
| 6,482,574 B1 | | 11/2002 | Ramaswami et al. | |
| 6,555,480 B2 | * | 4/2003 | Milligan et al. | 438/719 |
| 6,627,467 B2 | * | 9/2003 | Haluzak et al. | 438/21 |
| 2002/0054191 A1 | * | 5/2002 | Moon et al. | 347/56 |
| 2003/0081072 A1 | * | 5/2003 | Trueba | 347/63 |

FOREIGN PATENT DOCUMENTS

| | | | |
|---|---|---|---|
| EP | 0783970 A2 | | 7/1997 |
| EP | 0842776 A2 | | 5/1998 |
| EP | 0921001 A1 | | 6/1999 |
| JP | 407223319 A | * | 8/1995 |

OTHER PUBLICATIONS

USSN 10/115294 filed Apr. 3, 2002, entitled Ink Jet Printhead Having An Integrated Filter And Method Of Manufacture by Cruz–Uribe et al. (Now US Patent No. 6,582,064).

* cited by examiner

*Primary Examiner*—William E. Tapolcai
*Assistant Examiner*—Mohammad M. Ali

(57) ABSTRACT

A fluid ejection device comprises a substrate having a first surface; a fluid ejector formed over the first surface; and a cover layer defining a firing chamber formed about the fluid ejector, and defining a nozzle over the firing chamber. The cover layer is formed by at least two SU8 layers.

21 Claims, 7 Drawing Sheets

PLURALITY OF BARRIER LAYERS

FIELD OF THE INVENTION

The present invention relates to fluid ejection devices, and more particularly to a plurality of barrier layers in a fluid ejection device.

BACKGROUND OF THE INVENTION

Various inkjet printing arrangements are known in the art and include both thermally actuated printheads and mechanically actuated printheads. Thermal actuated printheads tend to use resistive elements or the like to achieve ink expulsion, while mechanically actuated printheads tend to use piezoelectric transducers or the like.

A representative thermal inkjet printhead has a plurality of thin film resistors provided on a semiconductor substrate. A barrier layer is deposited over thin film layers on the substrate. The barrier layer defines firing chambers about each of the resistors, an orifice corresponding to each resistor, and an entrance or fluid channel to each firing chamber. Often, ink is provided through a slot in the substrate and flows through the fluid channel defined by the nozzle layer to the firing chamber. Actuation of a heater resistor by a "fire signal" causes ink in the corresponding firing chamber to be heated and expelled through the corresponding orifice.

Continued adhesion between the nozzle layer and the thin film layers is desired. With printhead substrate dies, especially those that are larger-sized or that have high aspect ratios, unwanted warpage, and thus nozzle layer delamination, may occur due to mechanical or thermal stresses. For example, often, the nozzle layer has a different coefficient of thermal expansion than that of the semiconductor substrate. The thermal stresses may lead to delamination of the nozzle layer, or other thin film layers, ultimately leading to ink leakage and/or electrical shorts. In an additional example, when the dies on the assembled wafer are separated, delamination may occur. In additional and/or alternative examples, the nozzle layer can undergo stresses due to nozzle layer shrinkage after curing of the layer, structural adhesive shrinkage during assembly of the nozzle layer, handling of the device, and thermal cycling of the fluid ejection device.

SUMMARY

A fluid ejection device comprises a substrate having a first surface; a fluid ejector formed over the first surface; and a cover layer defining a firing chamber formed about the fluid ejector, and defining a nozzle over the firing chamber. The cover layer is formed by at least two SU8 layers.

DETAILED DESCRIPTION

Figure 1:
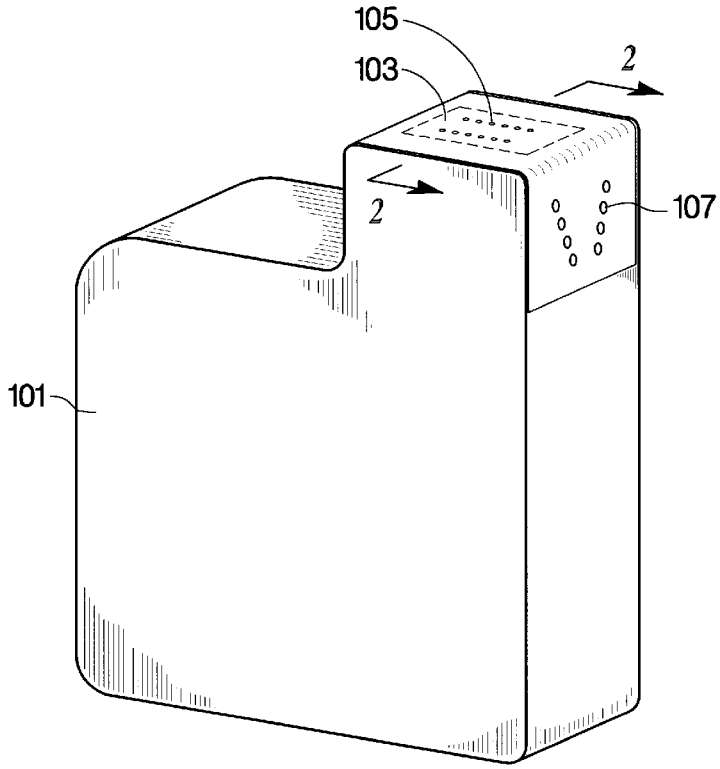
FIG. 1 illustrates a perspective view of an embodiment of a fluid ejection cartridge of the present invention.

FIG. 1 is a perspective view of an embodiment of a cartridge 101 having a fluid ejection device 103, such as a printhead. The cartridge houses a fluid supply, such as ink. Visible at the outer surface of the printhead are a plurality of orifices or nozzles 105 through which fluid is selectively expelled. In one embodiment, the fluid is expelled upon commands of a printer (not shown) communicated to the printhead through electrical connections 107.

Figure 2:
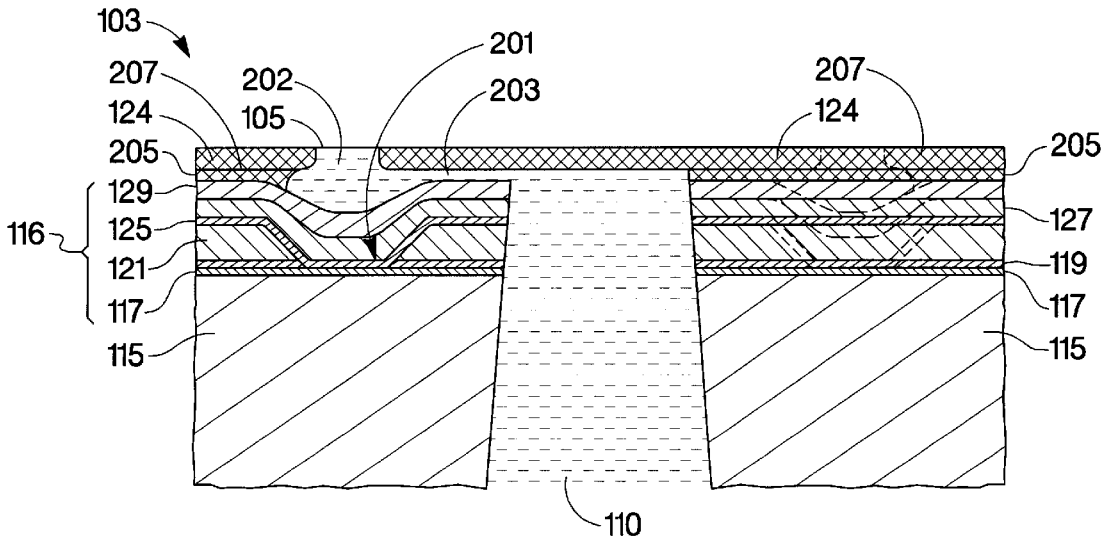
FIG. 2 illustrates a cross-sectional view of an embodiment of a fluid ejection device taken through section 2—2 of FIG. 1.

The embodiment of FIG. 2 illustrates a cross-sectional view of the printhead 103 of FIG. 1 where a slot 110 is formed through a substrate 115. Some of the embodiments used in forming the slot through a slot region (or slot area) in the substrate include wet etching, dry etching, DRIE, and UV laser machining.

In one embodiment, the substrate 115 is silicon. In various embodiments, the substrate is one of the following: single crystalline silicon, polycrystalline silicon, gallium arsenide, glass, silica, ceramics, or a semiconducting material. The various materials listed as possible substrate materials are not necessarily interchangeable and are selected depending upon the application for which they are to be used.

In the embodiment of FIG. 2, a thin film stack 116 (such as an active layer, an electrically conductive layer, and a layer with micro-electronics) is formed or deposited on a front or first side (or surface) of the substrate 115. In one embodiment, the thin film stack 116 includes a capping layer 117 formed over a first surface of the substrate. Capping layer 117 may be formed of a variety of different materials such as field oxide, silicon dioxide, aluminum oxide, silicon carbide, silicon nitride, and glass (PSG). In this embodiment, a layer 119 is deposited or grown over the capping layer 117. In a particular embodiment, the layer 119 is one of titanium nitride, titanium tungsten, titanium, a titanium alloy, a metal nitride, tantalum aluminum, and aluminum silicon.

In this embodiment, a conductive layer 121 is formed by depositing conductive material over the layer 119. The conductive material is formed of at least one of a variety of different materials including aluminum, aluminum with about ½% copper, copper, gold, and aluminum with ½% silicon, and may be deposited by any method, such as sputtering and evaporation. The conductive layer 121 is patterned and etched to form conductive traces. After forming the conductor traces, a resistive material 125 is deposited over the etched conductive material 121. The resistive material is etched to form an ejection element 201, such as a fluid ejector, a resistor, a heating element, and a bubble generator. A variety of suitable resistive materials are known to those of skill in the art including tantalum aluminum, nickel chromium, tungsten silicon nitride, and titanium nitride, which may optionally be doped with suitable impurities such as oxygen, nitrogen, and carbon, to adjust the resistivity of the material.

As shown in the embodiment of FIG. 2, the thin film stack 116 further includes an insulating passivation layer 127 formed over the resistive material. Passivation layer 127 may be formed of any suitable material such as silicon dioxide, aluminum oxide, silicon carbide, silicon nitride, and glass. In this embodiment, a cavitation layer 129 is added over the passivation layer 127. In a particular embodiment, the cavitation layer is tantalum.

In one embodiment, a cover layer, such as a barrier layer, 124 is deposited over the thin film stack 116, in particular, the cavitation layer 129. In one embodiment, the cover layer 124 is a layer comprised of a fast cross-linking polymer such as photoimagable epoxy (such as SU8 developed by IBM), photoimagable polymer or photosensitive silicone dielectrics, such as SINR-3010 manufactured by ShinEtsu™, or an epoxy siloxane, such as PCX30 manufactured by Polyset Co. Inc. in Mechanicsville, N.Y. In another embodiment, the cover layer 124 is made of a blend of organic polymers which is substantially inert to the corrosive action of ink. Polymers suitable for this purpose include products sold under the trademarks VACREL and RISTON by E. I. DuPont de Nemours and Co. of Wilmington, Del.

An example of the physical arrangement of the cover layer, and thin film substructure is illustrated at page 44 of the Hewlett-Packard Journal of February 1994. Further examples of printheads are set forth in commonly assigned U.S. Pat. Nos. 4,719,477, 5,317,346, and 6,162,589. Embodiments of the present invention include having any number and type of layers formed or deposited over the substrate, depending upon the application.

In a particular embodiment, the cover layer 124 defines a firing chamber 202 where fluid is heated by the corresponding ejection element 201 and defines the nozzle orifice 105 through which the heated fluid is ejected. Fluid flows through the slot 110 and into the firing chamber 202 via channels 203 formed with the cover layer 124. Propagation of a current or a "fire signal" through the resistor causes fluid in the corresponding firing chamber to be heated and expelled through the corresponding nozzle 105.

Figure 3:
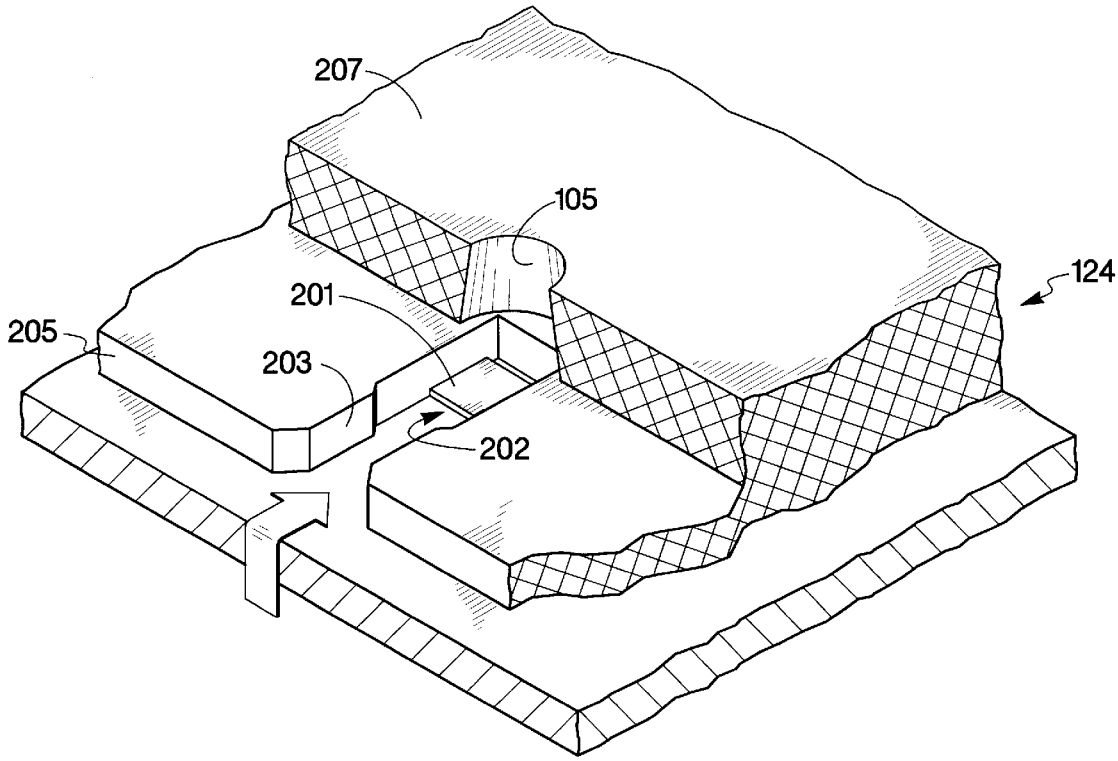
FIG. 3 is a perspective view of an embodiment of a barrier island and a corresponding firing chamber.

As shown in the cross-sectional and perspective views of the embodiment illustrated in FIGS. 2 and 3, respectively, the cover layer 124 includes two layers 205, 207. The first layer 205, such as a primer layer and a bottom layer, is formed over layer 129, and the second layer 207 (such as a top coat layer, a chamber layer, and a nozzle layer) is formed over layer 205. In this embodiment, the first layer 205 at least partially defines the firing chamber 202, and the second layer 207 defines a ceiling of the fluid channel 203, the remainder of the firing chamber and walls, as well as the nozzle 105. In another embodiment, not shown, the first layer 205 defines the firing chamber walls, and the second layer 207 defines the nozzle.

In one embodiment, layers 205 and 207 are formed of different materials. In this embodiment, layers 205 and 207 are formed of the same material. In alternative embodiments, the layers 205 and 207 are about the same thickness, or layer 207 is thicker than layer 205, or layer 205 is thicker than layer 207. In this embodiment, layer 205 is thinner than layer 207. In one embodiment, layer 205 has a thickness of about 2 to 15 microns, preferably 2 to 6 microns, preferably 2 microns. In one embodiment, layer 207 has a thickness of about 20 to 60 microns, preferably 30 microns. In one embodiment, the thickness of the primer layer is less than about 50% of the entire thickness of the layer 124.

In one embodiment, the primer layer 205 is a low viscosity SU8 material that is cured at 210° C. In another embodiment, the material for the primer layer 205 is chosen for resistance to ink and for adhesion to the thin film stack 116 and the nozzle or chamber layer. In another embodiment, the primer layer 205 is more flexible than the other layers of the cover layer 124. In yet another embodiment, the primer layer 205 has more ink resistance than the other layers of the cover layer 124. In another embodiment, the primer layer 205 is formed of NANO™ SU8 Flex CP which is a lower modulus SU8 formation. In another embodiment, the primer layer 205 is a flexibilized epoxy. In another embodiment, the primer layer 205 is a polyimide—polyamide layer. In another embodiment, the primer layer 205 is SU8 with alternative Photo-Acid-Generator (PAG) loading that makes the material photosensitive. In another embodiment, the primer layer 205 is cured to a higher temperature than that of other layers in the cover layer 124. With this higher temperature may come more resistance to ink, and more stress. However, the thickness of the layer 205 remains relatively thin to reduce undesirable cracking.

In one embodiment, the layer 207 has high resolution photolithographic characteristics. In one embodiment, the layer 207 is cured at 170° C.

Figure 4A:
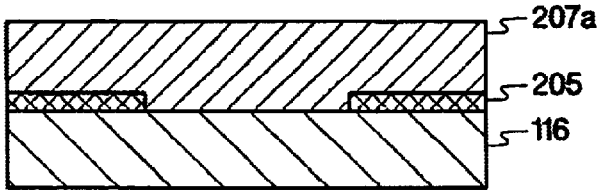
FIGS. 4A–4D are cross-sectional views of an embodiment of a process for the present invention.
Figure 4B:
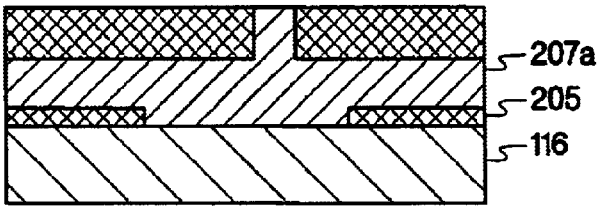
Figure 4C:
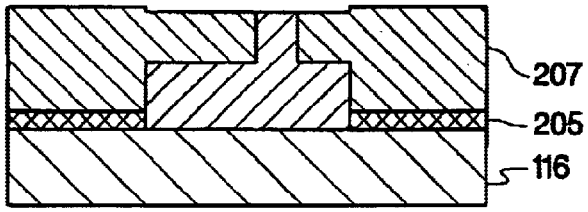
Figure 4D:
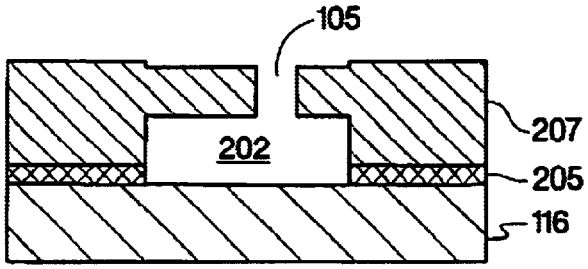
Figure 5:
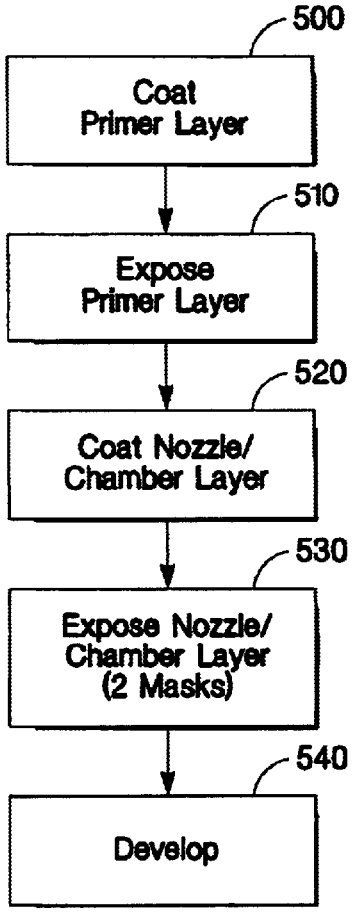
FIG. 5 is the flow chart for the views in FIGS. 4A–4D.

In the embodiment shown in FIGS. 4A–4D, the process of forming the two layer (205, 207) barrier layer 124 is illustrated. The embodiment of FIG. 5 shows the flow chart corresponding to the process illustrated in FIGS. 4A to 4D. The primer layer 205 is coated in step 500, and exposed in step 510. A nozzle layer material 207*a* coats the primer layer 205 in step 520 and as shown in FIG. 4A. In step 530 the nozzle layer 207 is exposed in two masks as shown in FIGS. 4B and 4C. In step 540, and as shown in FIG. 4D, the remaining unexposed nozzle layer material 207*a* is developed and thereby removed. The nozzle layer forms the firing chamber 202 and nozzle 105.

Figure 6:
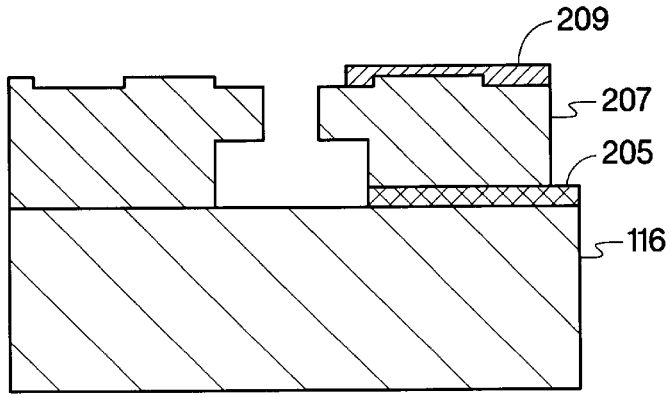
FIG. 6 is a cross-sectional view of an embodiment of the present invention, with layer in addition to that shown in FIG. 4D.

In the embodiment shown in FIG. 6, an additional top coat 209 is formed over the nozzle layer 207. In one embodiment the top coat 209 is photodefinable. In one embodiment, the top coat 209 is formed of SU8. In one embodiment, the top coat is non-wetting. In another embodiment, the top coat 209 is a planarizing layer to planarize the often rough topography of the nozzle layer. In yet another embodiment, the top coat 209 is a mask drawn to produce countersunk bores to reduce puddling. In another embodiment, the top coat 209 has low surface energy. In another embodiment, the top coat 209 is a siloxane based material. In another embodiment, the top coat 209 is a fluoropolymer based material. In one embodiment, the thickness of layer 209 is in the range of about ½ to 5 microns, preferably 1.1 microns.

Figure 7A:
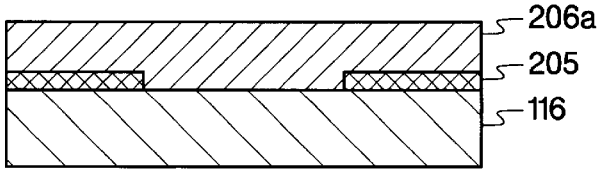
FIGS. 7A–7H are cross-sectional views of an embodiment of a process for the resent invention.
Figure 7B:
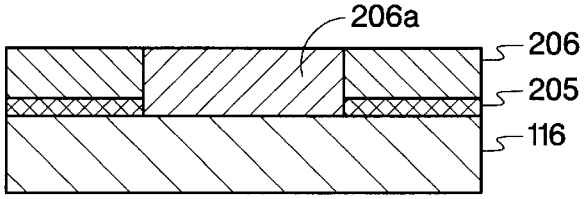
Figure 7C:
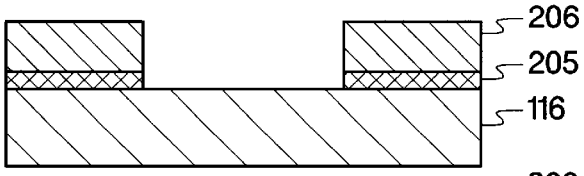
Figure 7D:
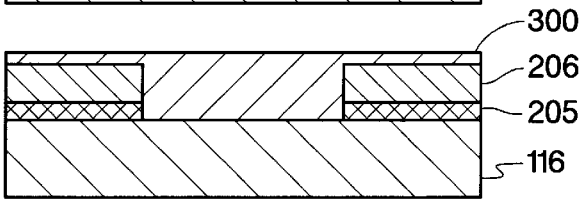
Figure 7E:
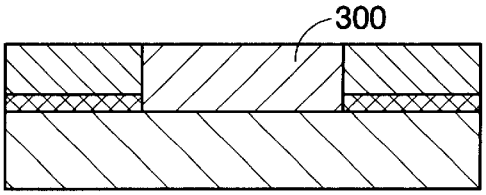
Figure 7F:
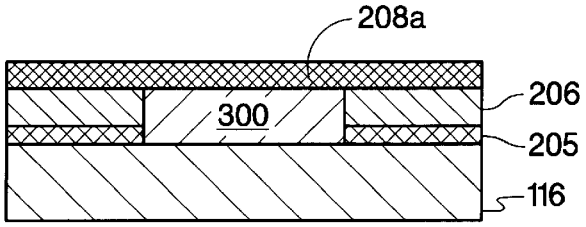
Figure 7G:
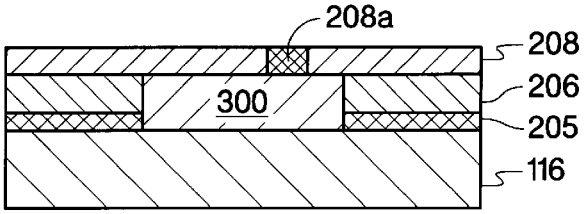
Figure 7H:
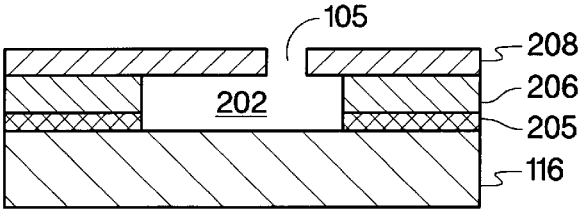
Figure 8:
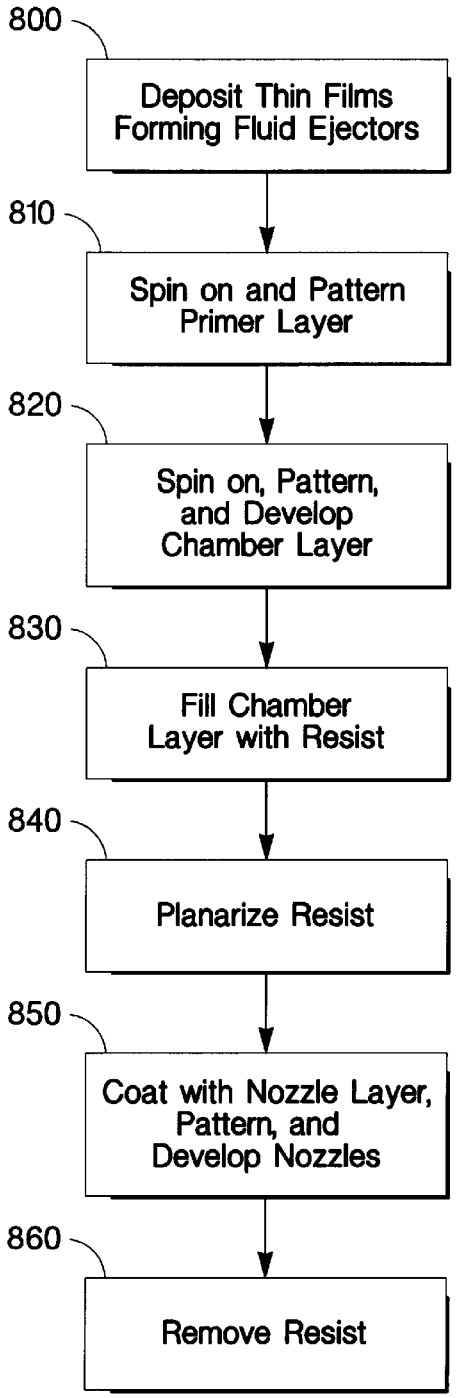
FIG. 8 is the flow chart for the views in FIGS. 7A–7H.

In the embodiment shown in FIGS. 7A–7H, the process of forming the three layer (205, 206, 208) barrier layer 124 is illustrated. The embodiment of FIG. 8 shows the flow chart corresponding to the process illustrated in FIGS. 7A to 7H. In step 800 the thin films 116 forming the fluid ejectors are deposited over the substrate. In step 810, the primer layer 205 is spun onto the thin film layers 116 and patterned. In step 820, and as illustrated in FIG. 7A, a material 206*a* that forms the chamber layer is spun on. As illustrated in FIG. 7B, the material 206*a* is patterned or exposed to form the chamber layer 206. As illustrated in FIG. 7C and in step 820, the material 206*a* is developed and thereby removed. In step 830, and illustrated in FIG. 7D, fill material 300, such as resist, coats the chamber layer 206. In step 840, and as illustrated in FIG. 7E, the fill material 300 is planarized, by methods such as CMP, patterning and developing of material. In step 850, and as illustrated in FIG. 7F, the chamber layer 206 and planarized material 300 is coated with a material 208a that forms the nozzle layer. As illustrated in FIG. 7G, the nozzle layer 208 is exposed. In step 850, the material 208a is developed. In step 860, and as illustrated in FIG. 7H, the fill material (such as resist) is removed. The method illustrated in FIGS. 7A to 7H, and in flow chart FIG. 8 may be referred to as the lost wax method.

The primer layer of FIG. 7H, in this embodiment, has a thickness in the range of about 2 to 15 microns, more particularly 2 to 6 microns, even more particularly 2 microns. In this embodiment, the chamber layer 206 and the nozzle layer 208 each have a thickness in the range of about 10 to 30 microns. In a more particular embodiment, at least one of the layers 206 and 208 have a thickness in the range of about 15 to 20 microns. In another embodiment, at least one of the layers 206 and 208 have a thickness of 15 or 20 microns.

In one embodiment, the nozzle layer 208 is formed of a material similar to that of layer 207 described above. In one embodiment, the chamber layer 206 is formed of a material similar to that of layer 207 described above. In another embodiment, the chamber layer 206 is formed of an SU8 with a photobleachable dye for z-contrast. In one embodiment, z-contrast refers to the direction perpendicular to the substantially planar substrate. In a more particular embodiment, z-contrast refers to placing an absorbing material in the formulation to extinguish the light intensity from top to bottom. In this embodiment, the 'contrast' refers to the sharpness of the transition between a photo acid concentration that causes the SU8 material to resist the developer and a concentration that is dissolved by the developer. In one embodiment, the sharper this transition; the more square the feature. In this embodiment, this photobleachable dye bleaches and becomes transparent at a sufficient dosage of electromagnetic energy.

Figure 9:
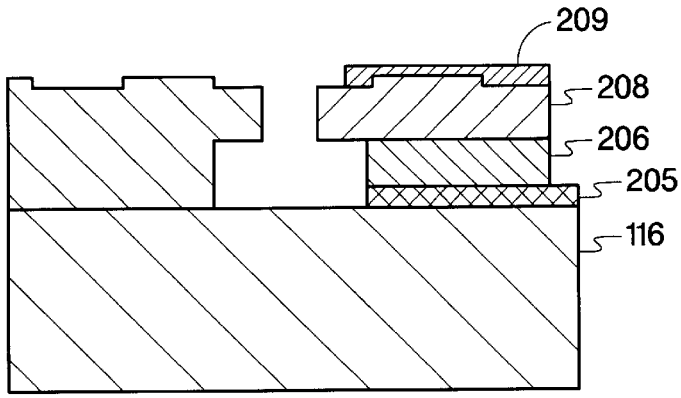
FIG. 9 is a cross-sectional view of an embodiment of the present invention, with layer in addition to that shown in FIG. 7H.

In the embodiment shown in FIG. 9, an additional top coat 209 is formed over the nozzle layer 208. The top coat 209 is similar to the top coat 209 described with respect to FIG. 6.

Figure 11:
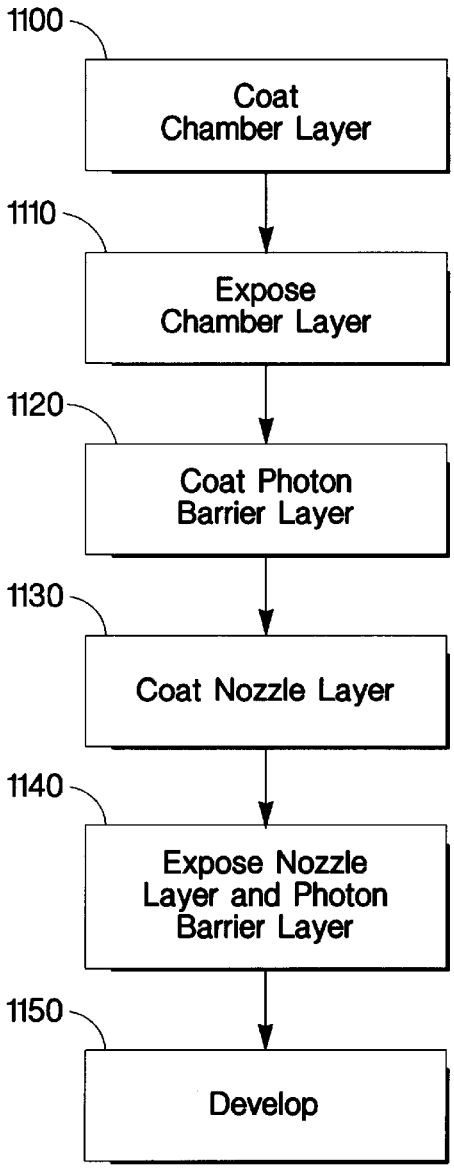
FIG. 11 is the flow chart for the views in FIGS. 10A–10F.

In the embodiment shown in FIGS. 10A–10F, the process of forming the four layer (205, 1206, 1000, 1208) barrier layer 124 is illustrated. The embodiment of FIG. 11 shows the flow chart corresponding to the process illustrated in FIGS. 10A to 10F. In step 1100 and in FIG. 10A, the material 1206*a* for forming the chamber layer is coated over the primer layer 205. In step 1110 and in FIG. 10B, the chamber layer 1206 is exposed thereby forming walls about a chamber, and leaving the unexposed material 1206*a* within the chamber area. In step 1120 and in FIG. 10C, material 1000*a* for forming a photon barrier layer is coated over the chamber layer 1206 and the material 1206*a*. In step 1130 and in FIG. 10D, material 1208*a* for the nozzle layer is coated over the photon barrier layer material 1000*a*. In step 1140 and in FIG. 10E, the nozzle layer 1208 and the photon barrier layer 1000 is exposed. The material 1206*a* remains in the chamber 202 and the materials 1000*a* and 1208*a* remain in the nozzle 105. In step 1150 and in FIG. 10F, the materials 1206*a*, 1000*a*, and 1208*a* are developed and thereby removed from the chamber and nozzle.

In this embodiment, the photon barrier layer 1000 is cast from a solution comprising at least one of an epoxy or acrylic resin, a binder, a solvent, a PAG (photosensitive), and an i-line dye (photon barrier). In one embodiment, the thickness of photon barrier layer 1000 is in the range of about ½ microns to 2 microns, preferably ½ micron. In another embodiment, the photon barrier layer is minimized, while being sufficiently absorbent.

Figure 10A:
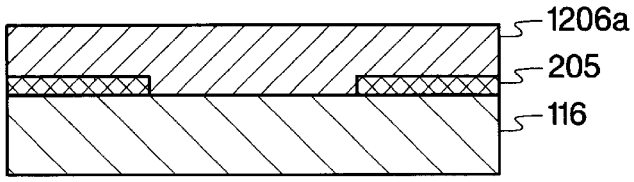
FIGS. 10A–10F are cross-sectional views of an embodiment of a process for the present invention.
Figure 10B:
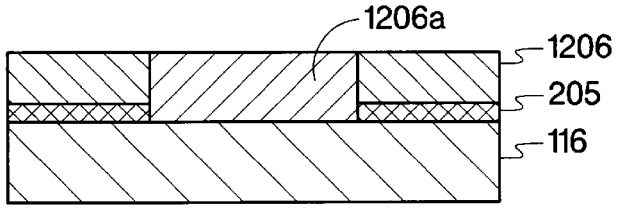
Figure 10C:
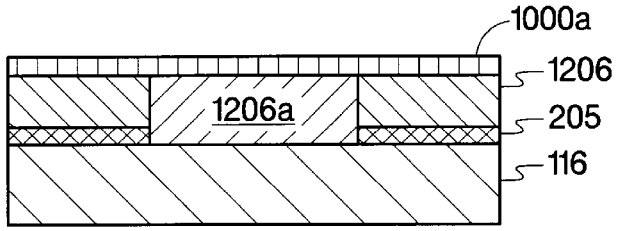
Figure 10D:
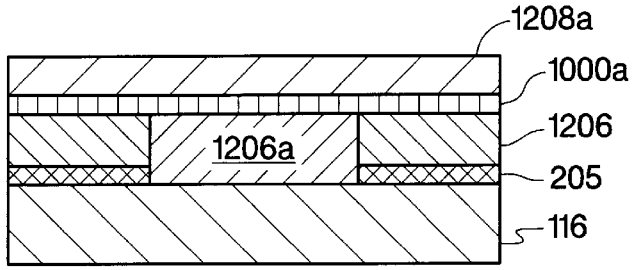
Figure 10E:
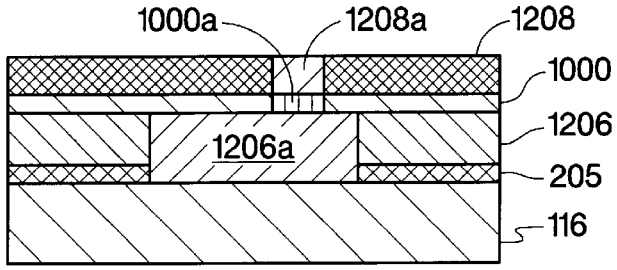
Figure 10F:
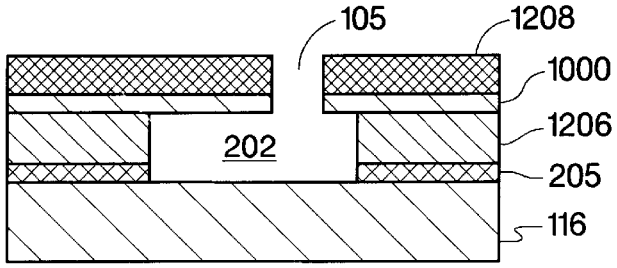

In one embodiment, the chamber layer 1206 and the nozzle layer 1208 are formed of a material similar to that of layer 207 described above. In one embodiment, the layer 1206 has a material similar to that of the layer 206. In another embodiment, the photon barrier layer 1000 is formed of SU8 with photobleachable dye, similar to that described with respect to an embodiment of layer 206 above. In one embodiment, the SU8 with photobleachable dye allows greater dimensional control and straighter edges. For example, as shown in FIG. 10F, the corner edges between the chamber and nozzle are substantially square edges.

Figure 12:
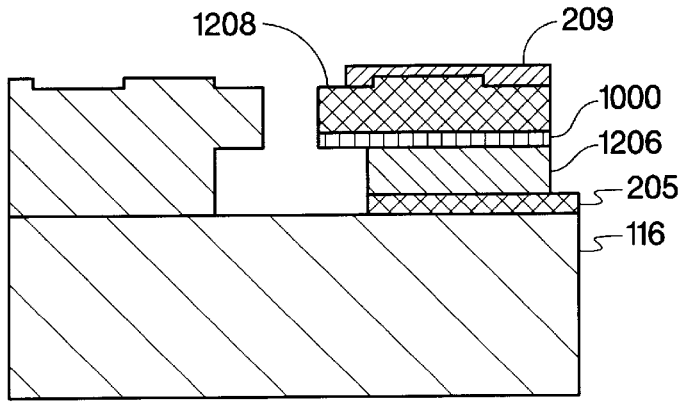
FIG. 12 is a cross-sectional view of an embodiment of the present invention, with a layer in addition to that shown in FIG. 10F.

In the embodiment shown in FIG. 12, an additional top coat 209 is formed over the nozzle layer 1208. The top coat 209 is similar to the top coat 209 described with respect to FIG. 6.

In one embodiment, at least one of the layers in the cover layer 124 in one of the previous embodiments is formed with the same initial basic coating material. However, that material is processed differently to give that layer different properties with respect to other layers in the cover layer 124. For example, in one embodiment, the one layer is exposed to a different dose of electromagnetic energy or cured at a different temperature than the remaining layers of the cover layer 124.

In one embodiment, the materials for the layers of the cover layer 124 are chosen for at least one of the following characteristics: CTE matching, ink resistance, stress relief, non-wetting ability, wetting ability, ability to photocure, high resolution processing capability, smooth surface, compatibility, and intermixing capability.

In one embodiment, at least one of the layers in the cover layer 124 in one of the previous embodiments is formed with a material that is patterned, or etched using at least one of the following methods: abrasive sand blasting, dry etch, wet etch, UV assisted wet etch, exposure and developing, DRIE, and UV laser machining. In one embodiment, at least one of the layers in the cover layer 124 in one of the previous embodiments is formed with a dry film.

In one embodiment, the materials forming the primer, chamber and/or nozzle layers are photodefined through i-line exposure. The i-line exposure is a type of exposure, in particular, about 365 nm wavelength exposure. In one embodiment, this photodefined pattern is covered with a resist material. In one embodiment, the resist is a positive photoresist, in a particular embodiment it is SPR-220. The resist is typically baked in a convection oven at a temperature between 110° C. and 190° C. to stabilize the resist for the subsequent planarization and bore or nozzle layer processing. In some embodiments, the solvent develop process that removes the unexposed chamber and nozzle layers is also used to remove the resist.

In one embodiment, at least one of the above-described embodiments maximizes trajectory control by reducing orifice-chamber alignment variability.

In one embodiment, ratios of SU8 ingredients, additives, and molecular weights of the SU8 oligomers are adjusted to give a range in the materials properties that are mentioned above.

It is therefore to be understood that this invention may be practiced otherwise than as specifically described. For example, the present invention is not limited to thermally actuated fluid ejection devices, but may also include, for example, piezoelectric activated fluid ejection devices, and other mechanically actuated printheads, as well as other fluid ejection devices. In an additional embodiment, the cover layer 124 of the present invention includes a plurality of layers, such as 4 layers, 5 layers, 6 layers, etc. Each of these layers may have either the same or a different material composition, depending upon the application. Thus, the present embodiments of the invention should be considered in all respects as illustrative and not restrictive, the scope of the invention to be indicated by the appended claims rather than the foregoing description. Where the claims recite "a" or "a first" element of the equivalent thereof, such claims should be understood to include incorporation of one or more such elements, neither requiring nor excluding two or more such elements.

What is claimed is:

1. A fluid ejection device comprising:

a substrate having a first surface;

a fluid ejector formed over the first surface; and a cover layer defining a firing chamber formed about the fluid ejector, and defining a nozzle over the firing chamber, wherein the cover layer is formed by at least two SU8 layers.

2. The fluid ejection device of claim 1 wherein each of the SU8 layers are formed from the same material.

3. The fluid ejection device of claim 2 wherein each of the SU8 layers are processed differently.

4. The fluid ejection device of claim 1 wherein the cover layer has a primer layer, and a nozzle layer, wherein the primer layer has a thickness that is less than 50% of the thickness of the cover layer.

5. The fluid ejection device of claim 4 wherein the primer layer has a thickness of about 2 microns.

6. The fluid ejection device of claim 4 wherein the primer layer is a low viscosity SU8 cured at 210° C.

7. The fluid ejection device of claim 1 wherein the cover layer has at least three layers including a primer layer coating thin film layers, a chamber layer defining the firing chamber, and a nozzle layer defining the nozzle.

8. The fluid ejection device of claim 7 wherein the chamber layer is SU8 with photobleachable dye.

9. The fluid ejection device of claim 1 further comprising a top coat layer formed over the cover layer.

10. The fluid ejection device of claim 9 wherein the top coat layer is photodefinable.

11. The fluid ejection device of claim 1 wherein at least one of the SU8 layers are patterned using at least one of the following methods: dry etch, wet etch, UV assisted wet etch, exposure and developing, DRIE, and UV laser machining.

12. The fluid ejection device of claim 1 wherein at least one of the layers of the cover layer is formed by a lost wax method.

13. The fluid ejection device of claim 1 wherein the materials for the layers of the cover layer are chosen for at least one of the following characteristics: CTE matching, ink resistance, stress relief, non-wetting ability, wetting ability, ability to photocure, high resolution processing capability, smooth surface, compatibility, and intermixing capability.

14. The fluid ejection device of claim 1 wherein at least one of the layers of the cover layer is formed of a dry film.

15. The fluid ejection device of claim 1 wherein the cover layer has at least four layers including a primer layer coating thin film layers, a chamber layer defining the firing chamber, a photon barrier layer with a nozzle layer defining the nozzle.

16. The fluid ejection device of claim 15 wherein the corner edges between the nozzle and the chamber, and defined by the photon barrier layer are substantially square.

17. An ink ejection device comprising:

a substrate having a first surface;

a thin film stack defining, an ink ejector and formed over the first surface; and a cover layer having a primer layer over the thin film stack, a chamber layer over the primer layer, and an orifice layer over the chamber layer, wherein the primer layer substantially adheres to the thin film stack and to the chamber layer, wherein the primer layer is substantially resistant to ink, wherein the chamber layer defines a firing chamber about the ink ejector, wherein the orifice layer defines an orifice over the firing chamber.

18. The ink ejection device of claim 17 wherein the chamber layer is formed with photobleachable dye for z contrast.

19. A method of forming a fluid ejection device comprising:

coating a thin film stack, including a fluid ejector, with a first material;

exposing the first material to form a first SU8 cover layer;

coating the first material with a second material;

exposing the second material to form a second SU8 cover layer; and developing the first and second material such that the first and second SU8 cover layers define a firing chamber about the fluid ejector and a nozzle.

20. The method of claim 19 wherein before the second material is coated, a photon barrier layer is coated over the first material, wherein the photon barrier layer is exposed with the second material.

21. A method of forming a fluid ejection device comprising:

coating a thin film stack, including a fluid ejector, with a first material;

exposing the first material to form a first SU8 cover layer;

coating the first material with a second material;

exposing the second material to form a second SU8 cover layer defining a chamber;

developing to remove the unexposed second material from the chamber;

filling the chamber with resist;

planarizing the resist;

coating the resist with a third material;

exposing the third material to form a third SU8 cover layer defining a nozzle; and developing to remove resist and third material.

* * * * *